US007784137B2

(12) United States Patent
Knopow

(10) Patent No.: US 7,784,137 B2
(45) Date of Patent: Aug. 31, 2010

(54) VACUUM DUSTER WITH FLEXIBLE FIBERS

(75) Inventor: Jeremy F. Knopow, Burlington, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 23 days.

(21) Appl. No.: 12/339,358

(22) Filed: Dec. 19, 2008

(65) Prior Publication Data

US 2009/0172912 A1 Jul. 9, 2009

Related U.S. Application Data

(60) Provisional application No. 61/019,885, filed on Jan. 9, 2008.

(51) Int. Cl.
*A47L 5/24* (2006.01)

(52) U.S. Cl. ..... 15/22.1; 15/207.2; 15/234; 15/396; 15/398; 15/400

(58) Field of Classification Search ..... 15/320–322, 15/207.2, 344, 396, 398, 399, 400, 22.1, 15/234; *A47L 5/24, 13/38*
See application file for complete search history.

(56) References Cited

U.S. PATENT DOCUMENTS

| | | | | |
|---|---|---|---|---|
| 1,902,534 | A | 1/1933 | Wielatz | |
| 2,036,789 | A | 4/1935 | Baker | |
| 3,721,502 | A | 3/1973 | Ognibene | |
| 4,675,053 | A * | 6/1987 | McCarty et al. | 134/21 |
| 4,956,892 | A * | 9/1990 | Fawkes | 15/339 |
| 4,972,541 | A | 11/1990 | Smith, Jr. | |
| 5,432,976 | A | 7/1995 | Alazet | |
| 5,590,439 | A | 1/1997 | Alazet | |
| 5,603,139 | A | 2/1997 | Alazet | |
| 5,692,263 | A | 12/1997 | Sorenson | |
| 5,909,755 | A | 6/1999 | Leal | |
| 6,101,671 | A | 8/2000 | Wright et al. | |

(Continued)

FOREIGN PATENT DOCUMENTS

| | | |
|---|---|---|
| DE | 129412 | 4/1902 |

(Continued)

OTHER PUBLICATIONS

PCT/US2007/022000 International Search Report & Written Opinion dated Apr. 21, 2008.

*Primary Examiner*—David A Redding

(57) ABSTRACT

Handheld dust removal devices that selectively utilize vacuum pressure are disclosed. Preferably, each device includes a small lightweight handle that houses a vacuum assembly having an electric motor and a battery. The device further includes a duster assembly with elongate fiber strands that have elongate voids extending therethrough or thereinto. The vacuum source can be fluidly connected to and draw a vacuum airflow through the duster assembly, for example, through and/or around the fiber strands. In such configuration, the elongate voids of the fiber strands can at least partially direct or influence the travel path of dust, debris, and/or other particulates that are entrained in a vacuum airflow. Some implementations further include an auxiliary vacuum inlet that is adapted and configured for drawing large particles such as crumbs, hair, and others thereinto. The auxiliary vacuum port can be displaced from the duster assembly, e.g., mounted to the handle or elsewhere.

19 Claims, 5 Drawing Sheets

U.S. PATENT DOCUMENTS

| | | | | |
|---|---|---|---|---|
| 6,746,166 | B1 | 6/2004 | Jeon et al. | |
| 6,799,350 | B1 | 10/2004 | Gordon | |
| 6,839,933 | B2 * | 1/2005 | Wheeler et al. | 15/320 |
| 2004/0154125 | A1 | 8/2004 | Houvener | |
| 2005/0015919 | A1 | 1/2005 | Stewart | |
| 2006/0048331 | A1 | 3/2006 | Rau et al. | |
| 2006/0185108 | A1 | 8/2006 | Hoadley | |
| 2008/0086834 | A1 | 4/2008 | Schwarz et al. | |

FOREIGN PATENT DOCUMENTS

| | | |
|---|---|---|
| DE | 393045 | 3/1924 |
| DE | 1863708 | 12/1962 |
| DE | 1729760 | 2/1972 |
| DE | 7338241 | 6/1974 |
| DE | 7404554 | 1/1975 |
| DE | 3528340 | 2/1987 |
| DE | 3831953 | 3/1990 |
| DE | 9011578 | 12/1990 |
| DE | 9206415 | 10/1992 |
| DE | 29612498 | 10/1996 |
| DE | 19749098 | 8/1998 |
| DE | 19800059 | 7/1999 |
| DE | 19857685 | 6/2000 |
| DE | 20008022 | 9/2000 |
| DE | 353491 | 7/2004 |
| EP | 0524405 | 6/1992 |
| EP | 0600225 | 6/1992 |
| EP | 0605280 | 12/1993 |
| WO | WO2005084510 | 9/2005 |

* cited by examiner

VACUUM DUSTER WITH FLEXIBLE FIBERS

CROSS REFERENCE TO RELATED APPLICATIONS

This application claims priority from U.S. Provisional Patent Application Ser. No. 61/019,885 filed on Jan. 9, 2008, the entirety of which is expressly incorporated by reference herein for all purposes.

BACKGROUND OF THE INVENTION

1. Field of the Invention

The present invention relates to cleaning and dusting devices in general. More particularly, it relates to cleaning and dusting devices having a vacuum integrated into a handle for enhancing various dust removal or cleaning characteristics of the cleaning implement.

2. Discussion of the Related Art

Numerous attempts have been made to incorporate vacuum or suction-type features into various cleaning tools and devices. The below-referenced U.S. patents and published U.S. applications disclose embodiments that were at least in-part satisfactory for the purposes for which they were intended. The disclosures of all the below-referenced prior United States patents and applications, in their entireties, are hereby expressly incorporated by reference into the present application for purposes including, but not limited to, indicating the background of the present invention and illustrating the state of the art.

U.S. Pat. No. 4,956,892 to Fawkes discloses a cordless vacuum brush. The vacuum brush includes a vacuum assembly containing a motor, fan, dust trap, and an elongated hollow handle assembly containing a plurality of battery cells connected in series for operating the motor. The handle assembly is detachably secured to the vacuum assembly. A generally rectangular flat elongated brush head with a hollow interior and peripheral pliable bristles is attached to the vacuum assembly. The head is flexible and moveable in relation to the vacuum assembly.

U.S. Pat. No. 4,972,541 to Smith, Jr. discloses a feather duster with a fan assembly/dust catching assembly. The dust catching system traps the dust stirred up by the feathers of the feather duster. The dust-catching system includes a fan unit which co-operates with a dust-catching element via a bell-shaped conduit. A skirt assembly is configured to move dust from the feather section to the dust-catching element. In one embodiment, the skirt assembly includes a turbulence-inducing area in which the dust-laden air is thoroughly mixed so the dust does not tend to settle out of the air before that air can be moved into the dust catching system.

U.S. Pat. No. 5,399,381 discloses a protective cover for electric brooms. The flexible fabric covering is intended to be placed over the head of a conventional electric broom. The application notes that the covering is preferably composed of a terrycloth-type material. The suction head of an electric broom is inserted into the first opening and a second opening is aligned with the suction opening formed through the floor-contacting surface of the electric broom.

U.S. Pat. No. 5,432,976 to Alazet discloses a device for collecting refuse and dust. The device includes an elongate body configured to carry a set of bristles. The body is hollow so as to contain, in its interior, a chamber for receiving refuse and dust. The refuse and dust are driven through a mouthpiece of an orifice via a vertical conduit, then through a channel into the receiving chamber. The vacuum and the suction are created by a suction turbine driven by an electric motor supplied by rechargeable electric batteries.

U.S. Pat. No. 5,720,078 to Heintz relates to a suction device for removing liquids from a surface. The device includes an air chamber formed from a top and a bottom plate. The air chamber is in fluid communication with a fitting adjacent thereto. The bottom plate includes a plurality of holes therethrough and a fabric adjacent thereto.

U.S. Pat. No. 5,909,755 to Leal discloses a vacuum dust mop to be used on furnishings, floors, and walls. The apparatus consists of a housing having suction slots on four sides and the bottom. A motor device sits within the housing and creates a vacuum which draws dust into the slots. A filter mechanism within the housing traps the dust for subsequent removal from the housing. The housing is covered by a soft cloth cover so as not to scratch the surfaces to be cleaned. The cover has a plurality of holes on the side and bottom in order to allow the dust particles to access the suction slots and an internally sewed glove to allow the unit to be hand held. An appenditure on the top of the housing has internal threads in order to accept a broom handle to allow the unit to be easily used on floors and walls.

U.S. Pat. No. 6,101,671 to Wright et al. discloses a self-contained mopping and drying system for floors that includes a housing, a handle extending from the housing, and a scrubbing member mounted on the housing. A pair of squeegees is mounted on the housing for collecting contaminated liquid on a floor surface, and a suction system is within the housing for removing the contaminated liquid from the floor surface to leave the floor in a substantially dry state. A tank is mounted on the housing for collecting the contaminated liquid that has been removed from the surface by operation of the suction motor, and a power source provides electrical power to the suction system.

U.S. Pat. No. 6,370,731 to Carter relates to a dusting attachment for a vacuum. The attachment includes a core unit with base and apex ends and three lengthwise oriented portions. The core is provided with a selected functional patterning of air apertures that extend through the core's outboard and inboard surfacing and communicate with the core's central air channel. A feathering system is attached to the interstitial spaces of the core's outboard surfacing.

U.S. Pat. No. 6,746,166 to Jeon et al. discloses an apparatus for cleaning stains and extracting cleaning fluid from a surface without requiring electrical power. A sprayer receives fluid from an attached refillable reservoir of cleaning solution. During scrubbing, the top of a pump actuator provides a resting place for the heel of a user's palm. The pump actuator may be locked down when scrubbing and unlocked for pumping to suck up fluid. A piston in a chamber provides the suction force for pulling fluid up through tubules, which may be interspersed between bristle tufts, past check valves and into a waste reservoir.

U.S. Pat. No. 6,799,350 to Gordon discloses a suction-assisted dust mop. An electric motor powered blower or fan is connected to a hollow tube to generate a suction for cleaning dust at multiple suction holes in the tube walls, which in turn generates suction in the fiber pile of the dust mop covering the suction holes. Chemical agents and/or an electrostatically charged fiber pile are disclosed along with suction to improve the efficiency of the dust cleaning process.

U.S. Pat. No. 6,921,438 to Lausevic relates to a vacuum cleaner attachment for fungi removal. The attachment includes an abrasive and porous pad for dislodging fungus. The debris and particulate matter generated by the abrasive process is drawn into the vacuum attachment and into the vacuum system.

U.S. Patent Publication No. 2005/0015919 to Stewart discloses an automatic dustpan broom. The broom includes an aspiration canal in the broom brush, reaching an aspiration tubing situated inside the broom handle. A motor is situated alongside the tubing and permits the aspiration of air through the aspiration canal and aspiration tubing by an opening along the tubing side. The opening is made of a semi permeable membrane which allows air to exit the tube while keeping dust inside.

U.S. Patent Publication No. 2004/0025271 to Shimada et al. relates to a cleaning device that includes a cleaning surface, a support arm, handle portion, and a pivot for pivotally supporting the support arm. The cleaning surface includes an adhesive surface and a cleaning cloth surface.

U.S. Patent Publication No. 2004/0148732 to Allard-Latour et al. discloses an end piece for a vacuum cleaner. The end piece includes a plate having a lower surface which rests on the ground and includes channels which direct suctioned air to a suction opening. The lower surface of the plate includes three suction channels between which a wiping device is mounted. The wiping device is not specifically defined; however, it is noted that the wipe may be damp, or dampened with a liquid conveyed to the wipe from a reservoir built into the nozzle.

U.S. Patent Publication No. 2004/0221419 to Franceoeur discloses a vacuum cleaner nozzle. The nozzle includes a body having a cleaning surface defining a first and second cleaning section. The first and second cleaning sections are provided with first and second dislodging bristles for dislodging the soiled particles from the soiled surface.

U.S. Patent Publication No. 2006/0048331 to Stewart relates to a floor cleaning machine having a microfiber pad. A microfiber cleaning assembly is mounted beneath the machine for cleaning the floor following the vacuum pick-up.

U.S. patent application Ser. No. 11/090,438 filed Mar. 25, 2005 discloses a soft surface remediation device. In one embodiment, the device includes a dust filter and may be attached to a vacuum for cleaning upholstery or touch up cleaning.

U.S. patent application Ser. No. 11/373,931 filed Mar. 13, 2006 discloses a duster that may be attachable to a vacuum.

Commonly owned U.S. application Ser. No. 11/090,438, filed on Mar. 25, 2005, and U.S. application Ser. No. 11/168,624, filed on Jun. 28, 2005, disclose various soft surface remediation devices, some of which utilize forced-air or pneumatic forces during use. Both U.S. application Ser. No. 11/090,438 and U.S. application Ser. No. 11/168,624, are incorporated herein by reference in their entireties for background purposes.

Commonly owned U.S. Provisional Patent Application Ser. No. 60/829,604, filed on Oct. 16, 2006, and its corresponding non-provisional U.S. application Ser. No. 11/873,131, filed on Oct. 16, 2007, disclose handheld dust removal devices, each configured to draw a vacuum airflow through and/or around a dusting cloth. Both U.S. Provisional Patent Application Ser. No. 60/829,604 and U.S. application Ser. No. 11/873,131, are incorporated herein by reference in their entireties for background purposes.

While satisfactory in various regards, the aforementioned devices are not without certain shortcomings and limitations for certain tasks. For example, such previous designs can be relatively complex technologically, expensive, and/or can prove cumbersome to use, especially for extended periods of time.

Accordingly, there still exists a need for a small vacuum utilizing duster adapted for single handed use, which can be used for relatively long periods of time without proving unwieldy and/or without overly fatiguing the user. Furthermore, a need exists for a small vacuum utilizing duster that can be used in a manner similar to handheld sweeping, brushing, or dusting devices, but having enhanced performance.

SUMMARY OF THE INVENTION

According to the invention, handheld dust removal devices that selectively utilize vacuum pressure are disclosed. Preferably, each device includes a small lightweight handle that houses a vacuum assembly having an electric motor and a battery. The device further includes a duster assembly with elongate fiber strands that have elongate voids extending therethrough or thereinto. The vacuum source can be fluidly connected to and draw a vacuum airflow through the duster assembly, for example, through and/or around the fiber strands. In such configuration, the elongate voids of the fiber strands can at least partially direct or influence the travel path of dust, debris, and/or other particulates that are entrained in a vacuum airflow. Some implementations further include an auxiliary vacuum inlet that is adapted and configured for drawing large particles such as crumbs, hair, and others thereinto. The auxiliary vacuum port can be displaced from the duster assembly, e.g., mounted to the handle or elsewhere.

The fiber strands can be used to mechanically dislodge, agitate, sweep, or otherwise move, e.g., dust, debris, or other particulates. It is further noted that since the fiber strands tend to bend, flex, and/or otherwise contort during use, so also do the respective elongate voids extending therethrough or therein. Correspondingly, as the fiber strands bend, flex, and contort, the vacuum airflow characteristics are dynamically influenced, which can present vacuum pressures at differing and dynamically changing positions and orientations with respect to the dust, debris, or other particulates. This can help pneumatically dislodge such dust, debris, or other particulates, and/or facilitate them being entrained into the vacuum airflow.

In some embodiments, the elongate voids extend longitudinally along the elongate fiber strands, optionally transversely thereinto. The elongate voids can be in fluid communication with the vacuum assembly. The transversely extending voids can connect to corresponding ones of the longitudinally extending voids, defining branching channels through the fiber strands. In this configuration, the branching channels collectively define a porous configuration of the elongate fiber strands. Or, the sidewall of the thickness of the fiber strands can be partially or entirely porous or even sponge-like.

In some embodiments, the assembly of fiber strands includes interspersed strands having different diameters. The strands can be attached to an annular shaped support head that can provide an opening through which a vacuum airflow may pass while being drawn toward the vacuum assembly.

The fiber strands can have symmetrical or non-symmetrical cross-sectional perimeter shapes, depending on the desired end use configuration and characteristics of the fiber strands. Such cross-sectional perimeter shapes can be, e.g., circular, polygonal, and/or generally irregular.

In some embodiments, the handle and duster assembly are arranged so that the vacuum assembly creates a vacuum airflow that is drawn through the duster assembly in a first direction, and is then drawn through the handle in a second, different direction. In this configuration, the handle can be positioned or maintained parallel to a surface while removing dust from the surface.

In some implementations, the handle, or other portions of the vacuum utilizing handheld duster, has an auxiliary vacuum inlet. The vacuum inlet can accommodate the vacuum removal of relatively large particles, for example, crumbs, hair, and/or other debris. The vacuum inlet can be selectively covered. For example, a removable cap, an actuatable door, or the duster assembly can selectively cover the auxiliary vacuum inlet These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and, therefore, non-limiting embodiments illustrated in the drawings accompanying and forming a part of this specification, wherein like reference numerals designate the same elements in the several views, and in which.

Figure 1:
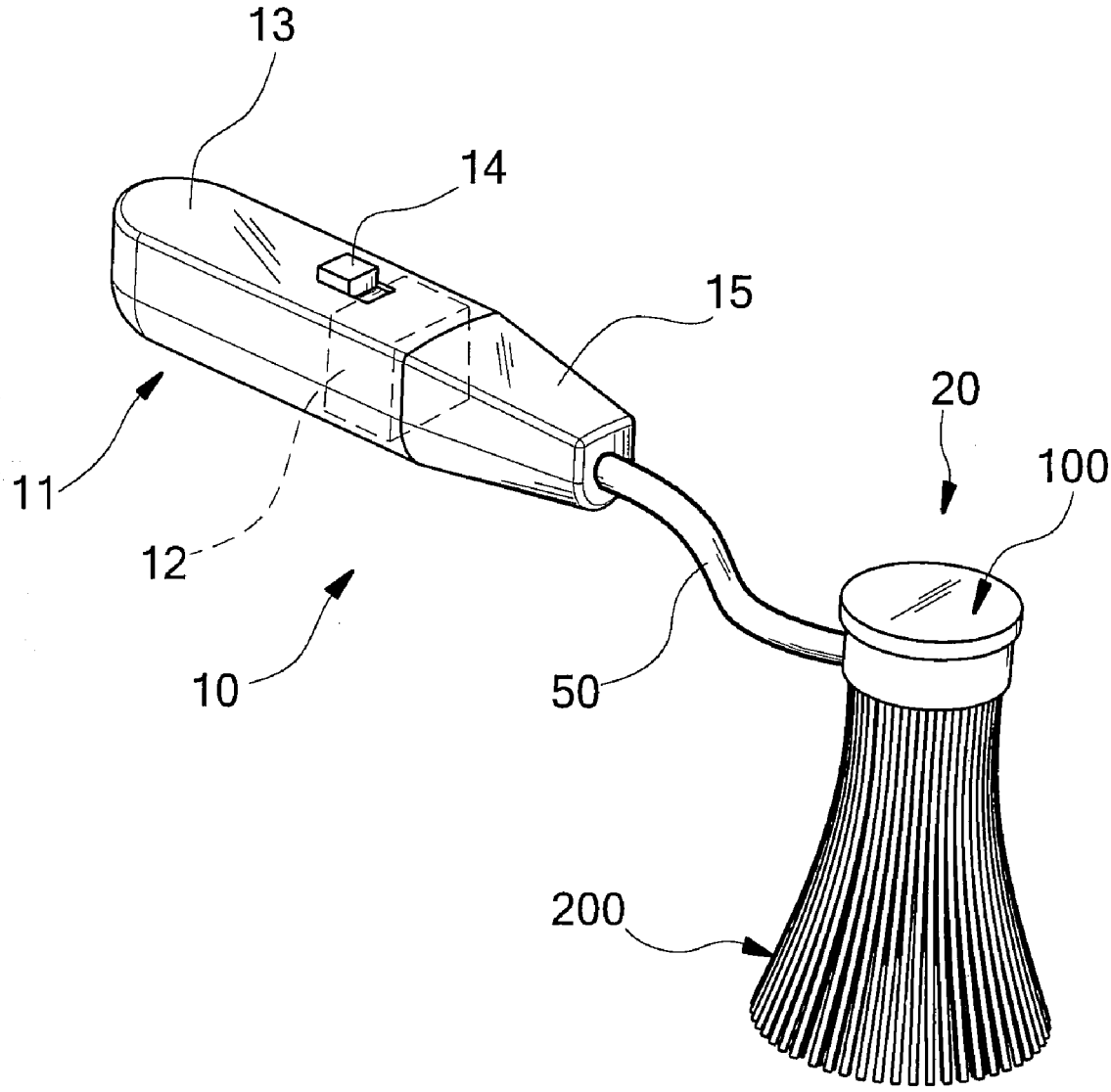
FIG. 1 is a perspective view of a first embodiment of a vacuum utilizing handheld duster of the invention.

In describing the preferred embodiment of the invention that is illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the words "connected", "attached", or terms similar thereto are often used. They are not limited to direct connection but include connection through other elements where such connection is recognized as being equivalent by those skilled in the art.

DETAILED DESCRIPTION OF THE INVENTION

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the examples should not be construed as limiting the scope of the present invention.

1. System Overview

In a basic form, the invention is a cleaning and/or dusting tool that employs certain features of a vacuum cleaner, e.g., the invention embodies a vacuum utilizing handheld duster. The vacuum utilizing handheld duster includes a vacuum source which can pull or draw suction through or around a duster assembly with elongate fiber strands that can be used to agitate, dislodge, or sweep, dust particles as well as other debris or particulates.

The vacuum utilizing handheld duster is small, lightweight, and easy to maneuver. It is adapted for single-handed operation and can be used for extended periods without user fatigue or discomfort. For example, the vacuum utilizing handheld duster can be continuously used for time periods that are generally of the same duration as required for typical household dusting tasks.

The vacuum utilizing handheld duster can be used as, e.g., a handheld sweeper yet does not require a dust pan or other debris collecting device. Rather, as dust, debris, or other particulates are swept by the fibers, they become entrained in a vacuum airflow and are pulled into and collected in the vacuum utilizing handheld duster. This allows a user to sweep and pneumatically draw dust away instead of using conventional wiping techniques which require dusting cloths, rags, or paper towels, or other dust removal accessories. Doing so reduces or eliminates the need to, e.g., wash such cloths or rags, and the cumulative expense of one-time use, disposable paper towels.

Furthermore, in some implementations, the vacuum utilizing handheld duster provides an auxiliary vacuum inlet and collection chamber to hold larger debris such as crumbs, pet hairs, and/or other hairs. In such implementations, the vacuum utilizing handheld duster has enhanced dust particle removing capabilities as well as the integrated capability of removing relatively large particles from surfaces as desired. This eliminates the need for a dustpan and brush, or separate vacuum cleaner.

2. Detailed Description of Preferred Embodiments

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the below examples should not be construed as limiting the scope of the present invention.

Figure 2:
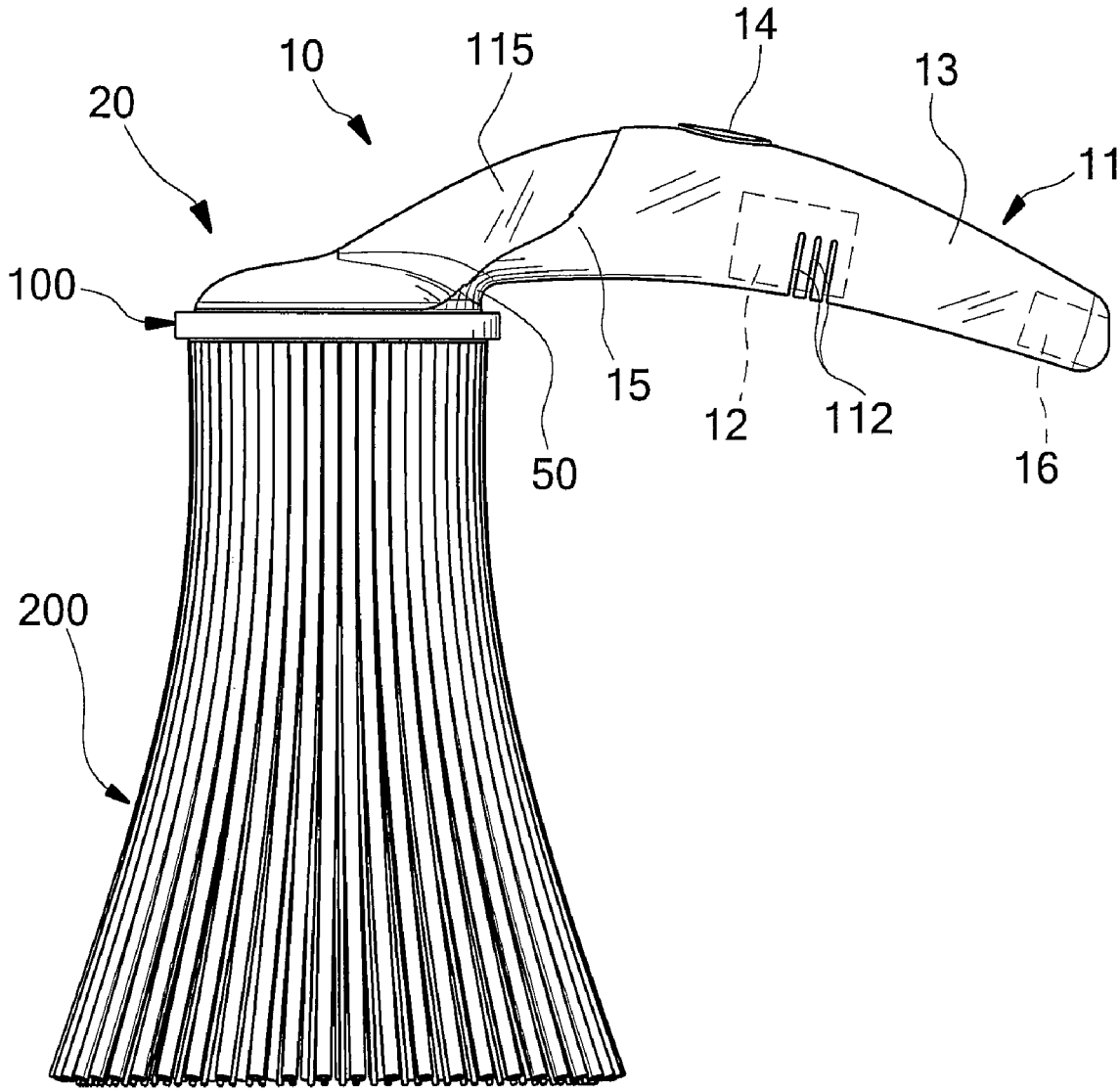
FIG. 2 is a side-elevation view of a second embodiment of a vacuum utilizing handheld duster of the invention.

Turning initially to FIGS. 1 and 2, the inventive cleaning or dusting tool, e.g., vacuum utilizing handheld duster 10, is illustrated according to one embodiment of the present invention. In this embodiment, vacuum utilizing handheld duster 10 includes a handle portion 11 that is connected to a duster assembly 20 by way of a neck 50. Handle portion 11 houses a vacuum source 12 therein. It is noted that the term "handle", as in handle portion 11, does not limit the structure(s) to gripping segments or portions of the duster 10 that are grasped by the hands of a user. Rather, handle portion 11 includes the entirety of the device enclosure, e.g., the body or housing that holds the internal components of the duster 10, whether such particular segments are physically grabbed by, or configured to be grabbed by, users or not. The handle portion 11 is made from lightweight and durable materials, preferably polymeric materials, and is made by injection molding or other suitable polymeric converting and forming processes.

The vacuum source 12 includes an electric vacuum motor and a corresponding power supply, e.g., one or more batteries, preferably, rechargeable batteries. Optionally, the vacuum utilizing handheld duster 10 includes a suitable power converter, whereby it may include a 120 VAC cord for powering the vacuum utilizing handheld duster 10 or for charging the batteries. As desired, the vacuum utilizing handheld duster 10 may be designed to sit within a charging cradle (not shown).

On/off switch 14 provides a user interface for selectively energizing the vacuum source 12. When the vacuum source 12 is energized, the vacuum motor creates a vacuum pressure or suction that establishes a flow of air into the handle, typically after traversing through other portions or components of the vacuum utilizing handheld duster 10, explained in greater detail elsewhere herein. Vacuum source 12 draws a vacuum through a vacuum inlet 16, which opens through the handle portion 11. Vacuum inlet 16 can be, for example, on an end of handle portion 11 that intersects the remainder of the vacuum utilizing handheld duster 10 (FIG. 2), or elsewhere as desired.

In some embodiments, the vacuum source 12 can also operate in reverse, whereby it can selectively emit an airflow through vacuum inlet 16 instead of drawing an airflow thereinto. This can allow the vacuum source 12 to facilitate cleaning of dust and/or other debris from the duster assembly 20, e.g., by blowing it therefrom, at least partially by way of its own pneumatic functionality. Furthermore, it is noted that the vacuum sources 12 need not be continuously energized. In other words, as desired, a user can remove dust and/or other particulate matter from a surface by way of handheld duster 10 while only periodically using its pneumatic dust removal enhancing features, for example, when encountering aged or other dust that may prove relatively more difficult to remove from a surface.

Handle portion 11 also includes a handle grip 13 that is preferably a curved ergonomically designed member configured to comfortably fit within the palm of a hand of a user. The handle grip 13 may be constructed in a wide variety of sizes depending on the intended use while allowing for ease of use, manipulation, packaging, shipping, and storage of the vacuum utilizing handheld duster 10 as well as increasing the overall ergonomics of the design. Preferably, the handle grip 13 is sized, adapted, and configured for single handed operation by the user, enabling the user to comfortably operate the vacuum utilizing handheld duster 10 for extended periods of time, while mitigating discomfort or fatigue. Thus, the handle grip 13, at least in combination with the overall mass of vacuum utilizing handheld duster 10, enables a user to continuously perform typical household dusting tasks.

Furthermore, the length of the handle portion 11 and/or handle grip 13, as compared to the overall length of vacuum utilizing handheld duster 11, and/or the placement of the center of mass of the vacuum utilizing handheld duster 10, is selected to provide suitable comfort to the user during extended use periods. The handle portion 11 is preferably less than about ⅔ of the overall length, optionally less than about ½ the overall length, of the vacuum utilizing handheld duster 10, so that the handle portion or handle grip 13 do not prove unwieldy during use. Preferably, the center of mass of the vacuum utilizing handheld duster 10 is located near the handle grip 13 to mitigate the non-desired lever arm force multiplication associated with placing a large portion of the device mass at its terminus, i.e., displaced from the user's hand.

Handle grip 13 may be constructed from a variety of synthetic resins, plastics, or other suitable materials such as polypropylene, as well as various resilient elastomeric materials. As desired, handle grip 13 or other parts of handle portion 11 may be constructed in a variety of colors for increased aesthetic appeal.

In some implementations, the handle portion 11 includes an enclosure, such as collection box 15, that is adapted to collect and hold the various particles that the vacuum utilizing handheld duster 10 intakes during use. As desired, the collection box 15 may be constructed from a translucent material so that the amount of debris that has been picked up and accumulated in collection box 15 is visually conspicuous to the user.

Collection box 15 or elsewhere on handle portion 11 can include one or more outlet vents 112 (FIG. 2) which vent off any positive pressure that would tend to accumulate in the collection box 15. Regardless of the particular location upon handle portion 11, the outlet vents 112 are adapted and configured to fluidly communicate with vacuum source 12. For example, vents 112 can be provided adjacent, e.g., an output side of the vacuum motor, to mitigate the likelihood of non-desired positive pressure buildup within the vacuum utilizing handheld duster 10.

Figure 3:
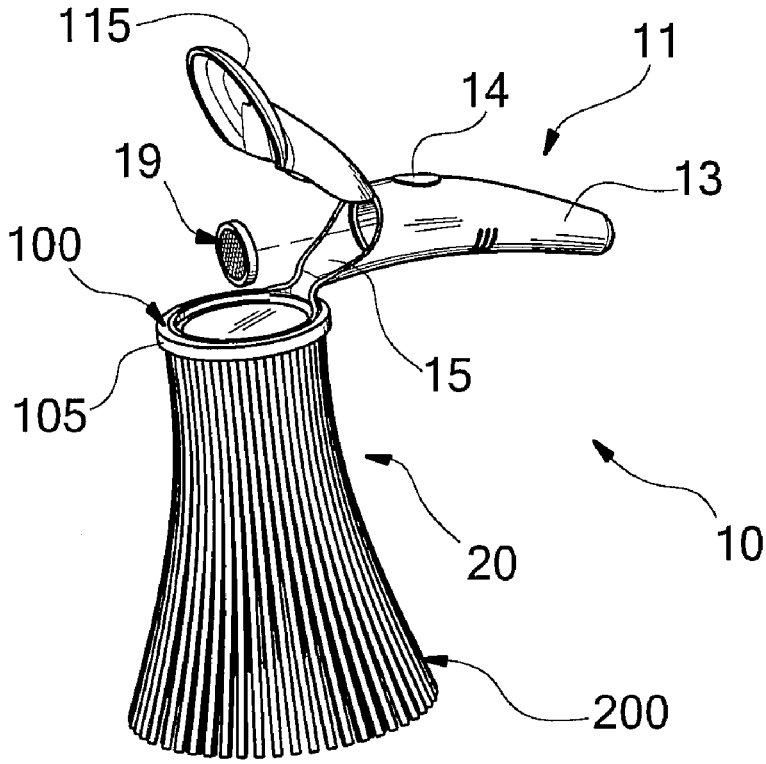
FIG. 3 is a partially exploded, perspective view of the vacuum utilizing handheld duster of FIG. 2.
Figure 4:
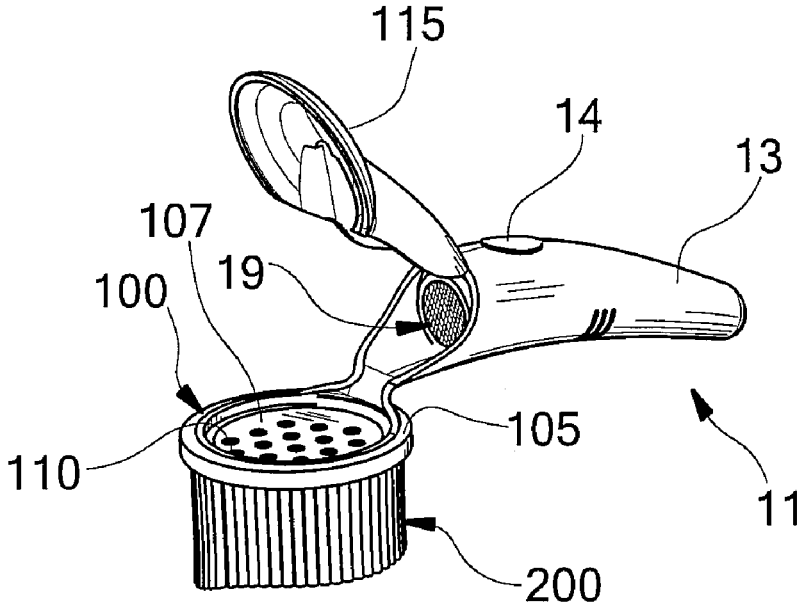
FIG. 4 is an enlarged pictorial view of a portion of the vacuum utilizing handheld duster of FIG. 3 with the filter element assembly installed.

Collection box 15 can be enclosed with a hinged cover 115 which, like collection box 15, may also be constructed from a translucent material. This permits the user to easily visually evaluate the amount of debris that has been picked up and accumulated in collection box 15. As seen in FIGS. 3-4, cover 115 can be hingedly connected to the handle portion 11, adjacent the switch 14. In this configuration, the cover 115 opens by pivoting upwardly away from the duster assembly 20. Other suitable configurations include, but are not limited to, e.g., a hinge mechanism at a lateral edge of the cover 115 so that it opens by pivoting laterally away from the handle portion 11, or other suitable hinged and non-hinged or removable configurations, as desired.

Still referring to FIGS. 3-4, a filter assembly 19 can be provided to capture small particulate matter, such as dust, debris, and/or other particulates. In other words, the filter assembly 19 holds various particles that are not retained in the collection box 15. The filter assembly 19 can be located between the collection box 15 and the vacuum source 12. In other embodiments, the filter assembly 19 is provided between the handle portion 11 and the duster assembly 20, or elsewhere, depending on the particular configuration of the vacuum utilizing handheld duster 10. Filter assembly 19 can be made from any of a variety of suitably filtering materials, e.g., natural and/or synthetic fibrous mats, woven or non-woven mats, and/or others. Furthermore, depending on the intended end-use environment, the filter assembly 19 can be treated with a tacky substance to increase particulate retention.

Regardless of the particular configuration of filter assembly 19, it is adapted and configured to collect and retain, e.g., various allergens, dust, debris, and/or other particulates, which are drawn through the duster assembly 20, preventing them from entering and potentially damaging the vacuum source 12. In some embodiments, filter assembly 19 is treated with a fragrance and/or is otherwise suitably scented. Preferably, filter assembly 19 is configured as a disposable limited use article, reducing or eliminating the need to periodically clean and/or disinfect the filter assembly 19.

The vacuum source 12 is fluidly connected to the duster assembly 20 by way of neck 50. As seen in FIG. 1, in some implementations, neck 50 is an elongate tubular member that is preferably flexible. Flexible embodiments of neck 50 enable a user to maneuver the duster assembly 20 into areas which might otherwise prove difficult with a completely rigid assemblage. Like other components of the vacuum utilizing handheld duster 10, as desired, the neck 50 can be a translucent material. This permits the user to visually determine whether dust, debris, and/or other particulates are flowing through the duster 10 for accumulation in collection box 15. Little or no visually conspicuous particulate flow could indicate a dirty or clogged air filter assembly 19 or other non-desired conditions.

Referring again to FIGS. 3-4, for implementations that require relatively more forceful applications of sweeping or scrubbing movements by the user, a generally rigid neck 50 proves desirable. For such applications, neck 50 can be an integral extension of the collection box 15, connecting the collection box 15 to duster assembly 20. It is noted that in some embodiments, duster assembly 20, or components thereof, is readily detachable from the remainder of the duster 10. In such configuration, the duster assembly 20, or components thereof, may be readily disposable items, reducing or eliminating the need to clean and/or disinfect the same.

Duster assembly 20 includes a support head 100 and fiber assembly 200 connected thereto. Best seen in FIG. 3, support head 100 can be configured as an annular ring that defines an end portion of the vacuum utilizing handheld duster 10. Support head 100 is configured so that a vacuum airflow can be directed through the concentric opening at its center, or through an annular wall 105. The annular wall 105 provides a mounting structure to which the fiber assembly 200 is attached, so that the portion of the vacuum airflow that is directed through the annular wall 105 is correspondingly directed through or around the fiber assembly 200.

Referring now to FIG. 4, in some embodiments, the support head 100 includes a disc or plate-type member, e.g., plate 107, which extends across the concentric opening of annular wall 105. Plate 107 has multiple apertures 110 extending therethrough which can be axially registered with portions of the fiber assembly 200 for directing the vacuum airflow through or around the fiber assembly 200.

Referring now to FIGS. 3-7, fiber assembly 200 includes multiple fiber strands 300A, 300B, 300C, 300D that extend axially from the support head 100. In some implementations, such as those seen in FIGS. 3-4, the fiber strands 300A, 300B, 300C, 300D extend downwardly from the perimeter of the support head 100, namely, from a bottom surface of annular wall 105. The particular number, relative positions, and arrangement pattern(s) of fiber strands 300A, 300B, 300C, 300D are selected to correspond to the desired use characteristics.

In some implantations, the fiber strands 300A, 300B, 300C, 300D extend about the entire circumference of annular wall 105 and are only one strand or row deep (FIG. 3). In other implementations, multiple rows of fiber strands 300A, 300B, 300C, 300D extend about the entire circumference of annular wall 105, providing a fiber assembly 200 which is again ring shaped when viewed from above, yet relatively thicker or wider. In yet other implementations, e.g., those seen in FIG. 4 and incorporating plate 107, the fiber assembly 200 can occupy substantially the entire space below the plate 107 and between the fiber strands 300A, 300B, 300C, 300D provided at the perimeter of fiber assembly 200. In other words, multiple fiber strands 300A, 300B, 300C, 300D can extend axially from the bottom surface of plate 107.

Figure 5:
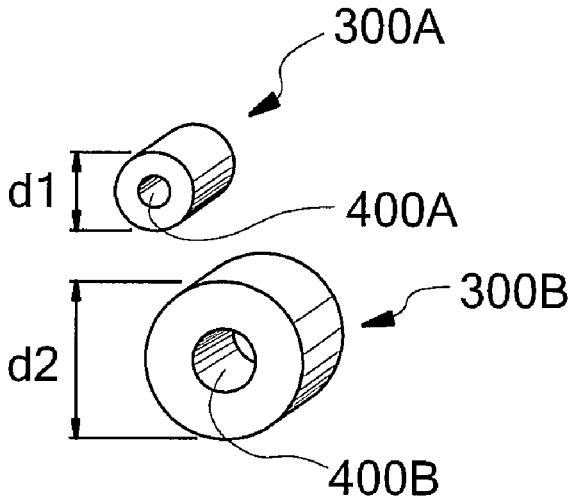
FIG. 5 is a pictorial view of two cross-sectional segments, having different diameters, each of a first embodiment of fiber strands having an annular cross-sectional configuration.
Figure 6:
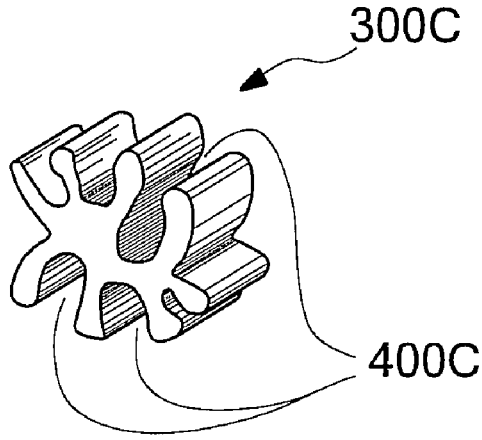
FIG. 6 is a pictorial view of a cross-sectional segment of a second embodiment of fiber strands, having an arcuate and irregular cross-sectional configuration.
Figure 7:
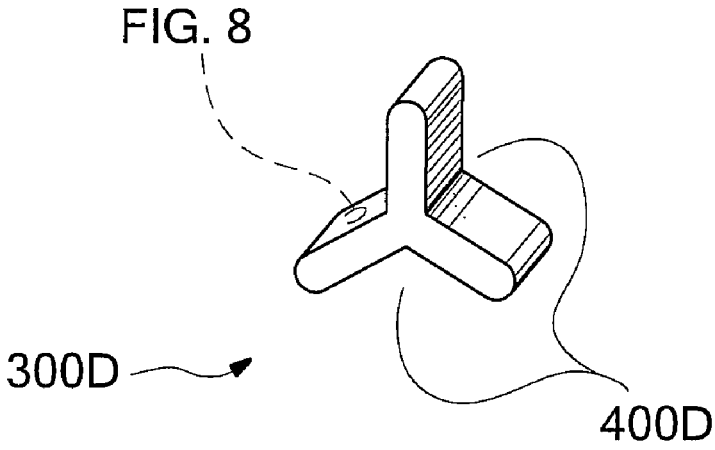
FIG. 7 is a pictorial view of a cross-sectional segment of a third embodiment of fiber strands, having a Y-shaped or generally polygonal configuration.
Figure 8:
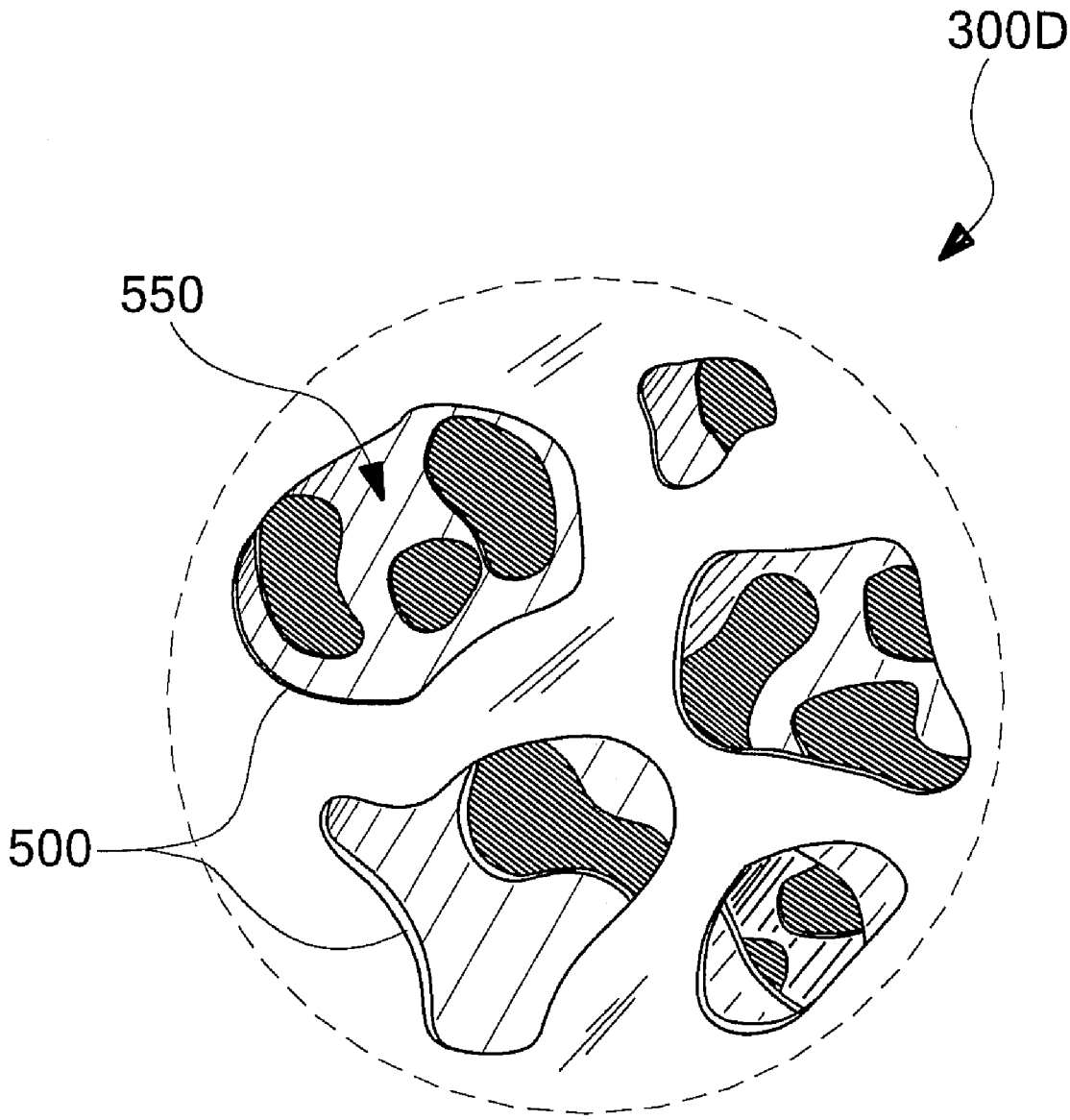
FIG. 8 is an enlarged, close-up, view of a portion of an outer surface of the fiber strand illustrated in FIG. 7, taken at the dashed circle in FIG. 7 labeled "FIG. 8."

Exemplary, non-limiting embodiments of fiber strand configurations are seen in FIGS. 5-7, as fiber strands 300A, 300B, 300C, 300D. The fiber strands 300A, 300B, 300C, 300D can be elongate fibers that preferably have porous sidewalls opening into, e.g., an internal void space that is columnar, elongate, or of other, for example, irregular configuration. One such example of a suitable porous sidewall configuration is shown in FIG. 8 that depicts an enlarged view of a portion of the sidewall of fiber strand 300D of FIG. 7, however it is noted that such porous sidewall configuration is equally applicable to all of the numerous contemplated suitable fiber strands, e.g., fiber strands 300A, 300B, 300C, and/or others. In such implementations, an outer sidewall surface has multiple pores or openings, namely sidewall openings 500, extending therethrough. Inwardly disposed pores, spaces, or channels, in combination with each other and with the sidewall openings 500 generally define a pore matrix 550 which preferable occupies the majority or the entire thickness dimension of the sidewalls of fiber strands 300A, 300B, 300C, 300D. Examples of suitable materials for use as fiber strands 300A, 300B, 300C, 300D include, but are not limited to, polymeric fibers that are typically used in thermoplastic and other hollow fiber filtration modules for hollow fiber water filtering or in hollow fiber bio-reaction systems, such as, e.g., various ones available from Koch Membrane Systems, Inc. having a place of business in Wilmington, Mass., USA.

In some implantations, the sidewall openings 500 and the pore matrices 550 have opening dimensions that are large enough to pass dust and/or other particulates therethrough. In this regard, the fiber strands 300A, 300B, 300C, 300D can be adapted and configured to transport dust and/or other particulates generally radially through the respective fiber strand sidewall, as well as generally axially or longitudinally toward the vacuum source 12.

Referring specifically to FIG. 5, some fiber strands 300A, 300B are elongate, columnar, resiliently flexible members that are cylindrical and thus having a circular perimeter shape when viewed in cross-section. The fiber strands 300A, 300B can have different sidewall thicknesses and/or diameters, e.g., diameter "d1" and diameter "d2" to provide differing flexibility and/or other use characteristics. The fibers can have enough rigidity to hold their own shape, and preferably enough give to "reach" areas that require dust removal but are difficult to access, such as, for example, crevices, gaps, and/or others. In other words, the fiber strands can have enough columnar strength so that they resist merely folding, collapsing, or crumpling when directed into small spaces, but rather resiliently or somewhat forcibly deflect into such small spaces.

Preferably, the fiber strands 300A, 300B include elongate voids, e.g., axial throughbores 400A, 400B. The axial throughbores 400A, 400B at least partially direct portions of the vacuum airflow therethrough. Correspondingly, during use, dust, debris, and/or other particulates can be pulled through the axial throughbores 400A, 400B as they flow toward collection box 15.

Referring now to FIG. 6, some fiber strands 300C are elongate, columnar, resiliently flexible members that include perimeters that are generally non-symmetrical, arcuate, and irregular in cross-sectional configuration. Preferably, the fiber strands 300C include elongate voids, e.g., grooves 400C. The grooves 400C can at least partially direct portions of the vacuum airflow longitudinally through the grooves 400C and therefore longitudinally along and adjacent respective surfaces of the fiber strands 300C. Correspondingly, during use, dust, debris, and/or other particulates can be pulled through and along the grooves 400C as they flow toward collection box 15.

Referring now to FIG. 7, some fiber strands 300D are elongate, columnar, resiliently flexible members that include perimeters that are generally symmetrical, polygonal, or Y-shaped in cross-sectional configuration. Preferably the fiber strands 300D include elongate voids, e.g., grooves 400D. The grooves 400D can at least partially direct portions of the vacuum airflow longitudinally through the grooves 400D and therefore longitudinally along and adjacent respective surfaces of the fiber strands 300D. Correspondingly, like grooves 400C, during use, dust, debris, and/or other particulates can be pulled through and along the grooves 400D as they flow toward collection box 15.

Referring now to FIGS. 6 and 7, the non-cylindrical perimeter shapes of fiber strands 300C, 300D can prove particularly desirable when the fiber strands 300C, 300D are made of a porous material. In other words, when fiber strands 300C, 300D include sidewall openings 500 and matrices 550, they present a relatively larger exposed surface area through which to draw dust, debris, and/or other particulates, at least as compared to cylindrically configured fibers of analogous size.

In light of the above, in a typical dusting or cleaning operation, the small size and light weight make the vacuum utilizing handheld duster 10 easy to hold and maneuver with a single hand, enabling the user to operate it for extended periods without user fatigue or discomfort. In using the vacuum utilizing handheld duster 10, the user energizes it via the on/off switch 14, and then uses the vacuum utilizing handheld duster 10 like, e.g., a handheld sweeper or a standard dry duster.

With the vacuum source 12 energized, the fiber assembly 200 wipes or brushes across the surface being cleaned or dusted, and has enhanced performance characteristics as compared to, e.g., the fiber assembly 200 or a duster cloth alone, without vacuum assistance. The performance of fiber assembly 200 is supplemented, assisted, and/or otherwise enhanced by the vacuum airflow that tends to entrain dust particles therein, drawing them into the vacuum utilizing handheld duster 10. Namely, the vacuum source 12 pulls air, i.e., creates vacuum pressure or suction, through or around the fiber assembly 200 via openings extending though annular wall 105 and/or plate 107 and correspondingly through the throughbores 400A, 400B and grooves 400C, 400D.

Thus, by drawing a vacuum through or around the fiber assembly 200, an airflow is established that flows into the vacuum utilizing handheld duster 10. Correspondingly, such vacuum airflow can entrain dust particles that are upon or floating above the surface being dusted and improve retention of dust particles on the fiber assembly 200. This is because the vacuum pressure provides a force in opposition to, e.g., gravitational, electrostatic, and/or other forces which tend to otherwise urge the particles away from the fiber assembly 200. Should any of the dust, debris, and/or other particles be encrusted or otherwise stuck to the surface being cleaned, the user can dislodge or free the same by using the fiber assembly 200 in a manner similar to a conventional brush or sweeping device.

Furthermore, for embodiments incorporating sidewall openings 500 and/or pore matrices 550, if any dislodged or free dust, debris, and/or other particles become airborne, they can be pulled through the sidewall openings 500 and into the porous matrix 550. At least some of the dust, debris, and/or other particles will be drawn by vacuum pressure through the porous matrix 550, along the length of the fiber strands 300A, 300B, 300C, 300D, and into the collection box 15 where it can accumulate.

In some implementations, relatively larger sized dust, debris, and/or other particles can enter the sidewall openings 500, but can be too large to traverse the length of the fiber strands 300A, 300B, 300C, 300D through the porous matrix 550. Accordingly, such relatively larger sized dust, debris, and/or other particles can become entrapped in the interstices between physical structures of the porous matrix 550, whereby the fiber strands 300A, 300B, 300C, 300D then also function as filter elements which collect relatively larger sized dust, debris, and/or other particles therein. When the fiber strands 300A, 300B, 300C, 300D collect enough dust, debris, and/or other particles to restrict flow therethrough, or if otherwise desired, the fiber assembly 200 is replaced with a new one to restore the desired functionality to the handheld duster 10.

It is apparent that the handheld duster 10 is able to draw dust, debris, and/or other particles (i) between the various fiber strands 300A, 300B, 300C, 300D, (ii) generally longitudinally through or along elongate voids such as throughbores 400A, 400B and grooves 400C, 400D, (iii) generally radially into the fiber strands 300A, 300B, 300C, 300 through sidewall openings 500, and/or (iv) through the void spaces of matrices 550, for removal from a surface being cleaned. The dust, debris, and/or other particles that is being removed can collect or accumulate in, e.g., the fiber strands 300A, 300B, 300C, 300D themselves, collection box 15, or elsewhere in the handheld duster 10, depending on the particular configuration. Correspondingly, during use, the handheld duster 10 can draw a volume of air about, toward, or through, the entire exposed surface area of the fiber assembly 200 or exposed surface area of the assemblage of the fiber strands 300A, 300B, 300C, 300D.

It is noted that in light of the reliantly flexible characteristics of the fiber assembly 200, during use, the fiber strands 300A, 300B, 300C, 300D are continuously bending, flexing, and/or otherwise contorting, as are the respective elongate voids, namely, throughbores 400A, 400B, and grooves 400C, 400D. Correspondingly, as the fiber strands 300A, 300B, 300C, 300D bend, flex, and contort, the vacuum airflow characteristics are dynamically influenced, which can present vacuum pressures at differing positions and orientations with respect to the dust, debris, and/or other particulates. In some instances, this can help pneumatically dislodge such dust, debris, or other particulates and/or facilitate them being entrained into the vacuum airflow.

Upon encountering relatively large debris or particles such as crumbs, dirt, or pet hair, the vacuum utilizing handheld duster 10 can be reversed in orientation so that the crumbs, dirt, or pet hair are aligned with and sucked up through the vacuum inlet 16 (FIG. 2). Once the collection box 15 is filled with dust, debris, and/or other particulates, it is emptied directly into a waste receptacle, thereby eliminating the need for a dustpan and brush, or separate vacuum cleaner.

Furthermore, any of the discussed vacuum utilizing handheld dusters 10 may also be sold as part of a kit as is described in U.S. patent application Ser. No. 11/450,839 filed Jun. 9, 2006, incorporated herein by reference. If sold as a kit, the vacuum utilizing handheld duster can be packaged and sold with, e.g., a handle portion 11, a cleaning fluid, a duster assembly 20, and one or more replacement duster assemblies 20. Alternately, the kit would not include the handle portion 11 but would include one or more of the various embodiments of the duster assemblies 20 having different combinations and configurations of fiber strands 300A, 300B, 300C, 300D. A consumer could then purchase the desired or additional duster assemblies 20 based on their preference or particular need.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept. Furthermore, all the disclosed features of each disclosed embodiment can be combined with, or substituted for, the disclosed features of every other disclosed embodiment except where such features are mutually exclusive.

I claim:

1. A handheld dust removal device comprising:

(a) a handle;

(b) a vacuum assembly provided within the handle; and (c) a duster assembly attached to the handle and having multiple elongate fiber strands, at least some of the elongate fiber strands including grooves extending into respective outer surfaces thereof, wherein the vacuum assembly cooperates with and draws an airflow through the duster assembly, such that the grooves of the elongate fiber strands influence travel paths of components of the airflow along lengths of the elongate fiber strands while traveling through the vacuum assembly.

2. The handheld dust removal device of claim 1 wherein each of the elongate fiber strands has multiple grooves extending into the outer surface thereof, the multiple grooves being spaced from each other.

3. The handheld dust removal device of claim 2 wherein the elongate fiber strands include voids extending transversely thereinto.

4. The handheld dust removal device of claim 3 wherein at least one of the transversely extending voids connects to at least one of the grooves.

5. The handheld dust removal device of claim 1, the elongate fiber strands further comprising branching channels that collectively provide a porous configuration to the elongate fiber strands.

6. A handheld dust removal device comprising:

(a) a handle;

(b) a vacuum assembly provided within the handle; and (c) a duster assembly attached to the handle and having multiple elongate fiber strands extending away from the handle and having at least one of (i) a hollow cylindrical perimeter shape with a throughbore extending axially therethrough, (ii) a non-cylindrical perimeter shape with at least one groove extending into an outer surface thereof, wherein the vacuum assembly creates a vacuum airflow that is drawn through the duster assembly in a first direction and is drawn through the handle in a second, different, direction, such that the handle can be positioned parallel to a surface while removing dust from the surface while dust that is entrained in the vacuum airflow is guided into the vacuum assembly by the at least one of the throughbore and groove of the multiple elongate fiber strands.

7. The handheld dust removal device of claim 6 wherein the multiple elongate fiber strands have porous sidewalls, allowing dust to penetrate thereinto.

8. The handheld dust removal device of claim 7 wherein pores of the porous sidewalls open into the throughbores of the multiple elongate fiber strands.

9. The handheld dust removal device of claim 7 wherein pores of the porous sidewalls open into the grooves of the fiber elongate fiber strands.

10. The handheld dust removal device of claim 9 wherein upper portions of the at least one of the throughbore and groove of the multiple elongate fiber strands is in fluid communication with the vacuum assembly.

11. The handheld dust removal device of claim 6 wherein the handle includes an auxiliary vacuum inlet.

12. The handheld dust removal device of claim l1 wherein auxiliary vacuum inlet is selectively covered.

13. The handheld dust removal device of claim 12 wherein a removable cap selectively covers the auxiliary vacuum inlet.

14. The handheld dust removal device of claim 12 wherein an actuatable door selectively covers the auxiliary vacuum inlet.

15. The handheld dust removal device of claim 12 wherein the duster assembly selectively covers the auxiliary vacuum inlet.

16. A handheld dust removal device comprising:

(a) a handle;

(b) a vacuum assembly provided within the handle;

(c) a duster assembly attached to the handle and including an annular support head; and (d) multiple elongate fiber strands having different diameters and being attached to and extending from the annular support head.

17. The handheld dust removal device of claim 16 wherein the annular support head extends generally orthogonally with respect to the multiple elongate fiber strands and wherein the multiple elongate fiber strands, in combination, define a ring-shaped fiber assembly extending from the annular support head.

18. The handheld dust removal device of claim 17, further comprising a plate spanning across a medial opening of the annular support head.

19. The handheld dust removal device of claim 18 wherein at least some of the elongate fiber strands define at least one of a Y-shaped cross-section and a non-symmetrical cross-sectional perimeter shape.

* * * * *